US011465721B2

(12) United States Patent
Gerhart et al.

(10) Patent No.: US 11,465,721 B2
(45) **Date of Patent: *Oct. 11, 2022**

(54) HARNESS SYSTEM

(71) Applicant: Hydrocinch, LLC, Ann Arbor, MI (US)

(72) Inventors: Corey S Gerhart, Ann Arbor, MI (US); Gregory Marquardt, Ann Arbor, MI (US)

(73) Assignee: HYDROCINCH, LLC, Ann Arbor, MI (US)

( * ) Notice: Subject to any disclaimer, the term of this patent is extended or adjusted under 35 U.S.C. 154(b) by 211 days.

This patent is subject to a terminal disclaimer.

(21) Appl. No.: 17/070,574

(22) Filed: Oct. 14, 2020

(65) Prior Publication Data

US 2021/0024189 A1 Jan. 28, 2021

Related U.S. Application Data

(63) Continuation of application No. 16/407,535, filed on May 9, 2019, now Pat. No. 10,864,975.

(60) Provisional application No. 62/668,972, filed on May 9, 2018.

(51) Int. Cl.
*B63H 8/56* (2020.01)
*B63H 8/58* (2020.01)

(52) U.S. Cl.
CPC ..... *B63H 8/56* (2020.02); *B63H 8/58* (2020.02)

(58) Field of Classification Search
CPC ..... B63H 8/16; B63H 8/54
See application file for complete search history.

(56) References Cited

U.S. PATENT DOCUMENTS 5,069,153 A * 12/1991 Pascher ..... B63H 8/56 114/39.18
6,293,215 B1 * 9/2001 Moorrees ..... A62B 35/0031 114/39.18
6,508,186 B2 1/2003 Veh
7,992,506 B1 * 8/2011 Patton ..... B63H 8/58 114/39.18

(Continued)

FOREIGN PATENT DOCUMENTS

WO 2018048301 3/2018

OTHER PUBLICATIONS

Real Watersports, "Mystic Majestic X Hamess Review", Video (online), Jun. 26, 2017. URL: https://www.youtube.com/watch?v=04c81 E-G2Y. Accessed Apr. 18, 2022.

*Primary Examiner* — S. Joseph Morano
*Assistant Examiner* — Jovon E Hayes
(74) *Attorney, Agent, or Firm* — Carlson, Gaskey & Olds, P.C.

(57) ABSTRACT

A harness system includes a spreader bar having first and second elongate end portions at its respective ends. A curved support member is interconnected to the spreader bar by way of a plurality of straps. The straps include first and second adjustment straps connected to the first elongate end portion and to the curved support member. The first and second adjustment straps are arranged at a non-parallel angle to one another. Fixed straps may be located on a side opposite the adjustment straps. The arrangement and configuration of the spreader bar, curved support member, and adjustment straps provides an improved adjustable harness.

14 Claims, 10 Drawing Sheets

(56) References Cited

U.S. PATENT DOCUMENTS

| | | | | |
|---|---|---|---|---|
| 9,758,221 | B2 * | 9/2017 | Harrington | B63H 8/58 |
| 9,957,022 | B2 * | 5/2018 | Cabrinha | B63H 9/1007 |
| 9,994,290 | B2 * | 6/2018 | Cabrinha | B63H 8/58 |
| 2002/0088386 | A1 * | 7/2002 | Veh | A62B 35/0006 114/39.18 |
| 2003/0236154 | A1 * | 12/2003 | Miceli | A47D 13/046 482/69 |
| 2011/0008793 | A1 | 1/2011 | Lucero | |
| 2016/0198691 | A1 * | 7/2016 | Emery | A01L 3/00 168/16 |
| 2016/0221649 | A1 * | 8/2016 | Harrington | B63H 8/58 |
| 2017/0275150 | A1 * | 9/2017 | Taylor | B68B 5/00 |
| 2019/0344863 | A1 * | 11/2019 | Gerhart | B63H 8/56 |

* cited by examiner

HARNESS SYSTEM

CROSS-REFERENCE TO RELATED APPLICATION

This application claims priority to U.S. Provisional Patent Application No. 62/668,972 filed on May 9, 2018 and entitled HARNESS SYSTEM, and to U.S. Utility application Ser. No. 16/407,535 filed on May 9, 2019 and entitled HARNESS SYSTEM, each of which are hereby incorporated by reference

FIELD OF INVENTION

The present version of these embodiments relate generally to the field of harnesses utilized in outdoor sporting where an energy source such as the wind propels the user such as in the sport of kiteboarding.

BACKGROUND

These embodiments relate to kiteboarding harnesses, and more particularly to enhancements and improvements and new embodiments in the field of harnesses used for kite boarding. While this disclosure relates to harnesses used in the kiteboarding area, it should be understood and appreciated that this device can be utilized in many other sports. No limitation to the fields of use of this device is intended from this disclosure.

Other sports where this device could be used include, kite surfing, kite boarding, wind surfing, sailing, snow kiting or skiing and land boarding to name a few. This list is not exclusive and these examples are not meant to limit the scope of the device or its use. Kiteboarding is used as an example to explain the benefits and features of the device relative to the existing hardware.

Kiteboarding involves a board similar to a wakeboard having a predetermined length and width and most times having attachments to aid the user in keeping the feet to the board and vice versa. The user wears a harness generally around the waste which sometimes incorporates leg straps.

The kite or powering unit to the system is generally affixed to the harness. The kite catches the wind pulls the user and board along the surface of the water allowing the user to perform tricks or just motor across the surface of the water utilizing the wind energy.

There is generally at least one center line from the user's harness to the kite that runs through a steering bar. The steering bar generally has two additional lines from the ends of the steering bar to the kite. To steer a kite, the user must push one end of the steering bar away from the body while pulling the opposite end towards the body. Pushing and pulling opposite ends of the steering bar can effect turns in both directions. Additionally, the steering bar can be moved closer to or further from the kite and this action can be used to power or de-power the kite to increase or decrease speed. So steering the kite and powering and de-powering the kite can enable the user to do tricks or stunts or just enjoy a ride.

The harness that is used generally circumscribes the user's waist. The harness generally has adjustments to accommodate different waist sizes. This accommodation is generally accomplished with the use of adjustable straps of webbing. The webbing can be tightened or loosened to assist the harness in maintaining a secure attachment to the user.

The harness generally has a rigid spreader bar with a pull (or center) hook or attachment where the main or center lines from the kite are affixed. Many of the devices also have hooks on each end of the spreader bar. As one can imagine this center line can transfer a significant amount of force from the kite to tow or haul the user, board and equipment through and on top of the water.

The center hook is generally centrally located on the spreader bar. The spreader bar is generally relatively rigid and affixed to the harness via the hooks on each end of the spreader bar and by other means. The spreader bar should be maintained near the center of the user when in use to aid in steering and control. The spreader bar and harness are secured and adjusted with webbing straps running from the hooks on the ends of the spreader bar to the harness. Many systems incorporate a hook affixed to the webbing where these webbing hooks hook over the hooks at the ends of the spreader bar. This configuration makes it easier and quicker to remove the harness from the user. The hooks on the spreader bar and webbing hooks many times do not fit as securely as one would desire. There is also some caution needed such that the webbing hooks do not disengage from the spreader bar hooks. Also twisting relative to the webbing hooks and spreader bar hooks can occur.

Obviously, the user when using a kiteboarding system—there is water involved and harnesses have been known to lose tension in the straps from stretching and when soaked with water. Nylon webbing can also stretch from use, while water accelerates this action just providing constant tension to webbing can cause it to stretch. Stretching webbing thus loosens the harness around the users waist. This can be inconvenient, uncomfortable or even dangerous depending upon how loose the straps of the harness become.

One problem with typical harnesses when the straps stretch is that the harness will twist more with the same force from the kite line. Because the spreader bar is no longer secured against the users waist, the top of the spreader bar and harness will tend to dig into the users abdomen, while the bottom of the spreader bar and harness twists away from the user. This is due to the upward force and torque on the hook from the center line of the kite to the spreader bar and thereby the harness.

When the webbing straps become wet from the water—loosen and stretch, this condition can become uncomfortable and even somewhat dangerous to the users. Since the user generally needs to maintain both hands on the steering bar for better control, the tightening of these loosened stretched water soaked straps can be difficult. If this condition becomes too uncomfortable or dangerous such that control is compromised, the user may be forced to drop the kite to free the hands to tighten these loose straps. The user must then re-launch the kite which can require considerable effort and most times requires another person to assist in the re-launch. Obviously if one is any distance from their assist person, this can result in the difficult decision to continue to kiteboard with the loosened compromised strap(s) or drop the kite and hope that one can re-launch the kiteboard alone without the assist person.

For the foregoing reasons, there is a need for a harness that spreads the loading to the harness to help prevent the twisting of the spreader bar and harness in the case of loosened straps. There is a need for a harness that helps prevent the straps from loosening if they do get water soaked and or stretched from use. Additionally, if the straps could more easily be adjusted by a user, the user might not be required to drop the kite to manually tighten the straps. It would be helpful if the user could increase the tension of the straps if needed with only one hand. Increased comfort and control could be accomplished if there was a device that would discourage the loosening of the device that retains the spreader bar to the harness. There is also a need for a spreader bar that more evenly spreads the load from the center hook to the harness.

In view of the foregoing disadvantages inherent in the field of harness systems for kiteboarding and other sports, there is a need for a new harness that helps eliminate the problem of the straps loosening from stretching or when soaked in water. There is a need for a new harness to better spread the load from the kite to the harness to help decrease the twisting of the harness while in use.

SUMMARY

A harness system is generally presented. The harness system includes a spreader bar having a first end, a second end, and a center hook. First and second elongate end portions are fixed to the first and second ends of the spreader bar respectively. A curved support member is interconnected to the spreader bar by way of a plurality of straps. The straps include a first adjustment strap connected to the first elongate end portion at a first connection point and connected to the support member at a second connection point, and a second adjustment strap connected to the first elongate end portion at a third connection point and connected to the support member at a fourth connection point. The straps are arranged at a non-parallel angle to one another. In an embodiment, the distance between the second and fourth connection points is greater than the distance between the first and third connection points. In another optional embodiment the straps may be arranged in a crisscrossed configuration.

The harness system may further include a first and second fixed straps interconnecting the spreader bar with the curved support member on a side opposite the adjustment straps. The first and second fixed straps may be arranged at a non-parallel angle with respect to one another.

A first objective of these embodiments is to provide a device that is adjustable and useable for many different sized waist users.

Another objective of these embodiments is to provide a device that does not expand or loosen as much as the background art when soaked in water.

Another objective of these embodiments is to provide a device that has minimal stretching and loosening when put into use.

It is yet another objective of these embodiments to provide a device that can be more easily adjusted if needed.

It is a still further object of these embodiments to provide a device that will more securely affix the spreader bar and harness to the user.

Another objective of these embodiments is to provide a device that will result in less torque from the load and harness to the user such that the device does not become uncomfortable or hazardous.

These together with other objectives of these embodiments, along with various features of novelty which characterize these embodiments, are pointed out with particularity in this application forming a part of this disclosure. For a better understanding of these embodiments, the operating advantages and the specific objectives attained by its uses, reference should be had to the accompanying drawings and descriptive matter in which there is illustrated a preferred embodiment.

BRIEF DESCRIPTION OF THE DRAWINGS

The operation of the invention may be better understood by reference to the detailed description taken in connection with the following illustrations, wherein.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

Figure 1:
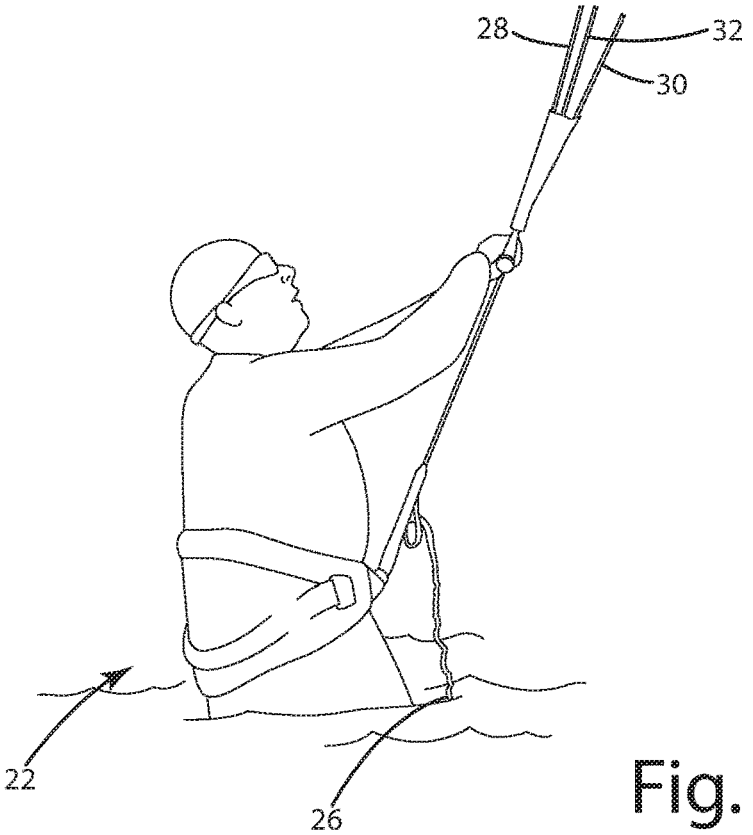
Fig. 1 (Prior art)
FIG. 1 illustrates a kiteboard user and assistant utilizing a known harness.

Referring to the drawings in detail wherein like elements are indicated by like numerals, there is shown in FIG. 1 one example of a user using a harness 22 while participating in a water sport. FIG. 1 also shows the first steering line 28 and second steering line 30 and the center line 32. While this example shows one center line 32 attached to two lines near the top of FIG. 2, it should be understood that the center line 32 could split into several source lines from, in this example, the kite (not shown). Other wind sports could utilize more center lines also, but generally, the center line affixes to the user and runs through the steering bar 34.

Figure 2:
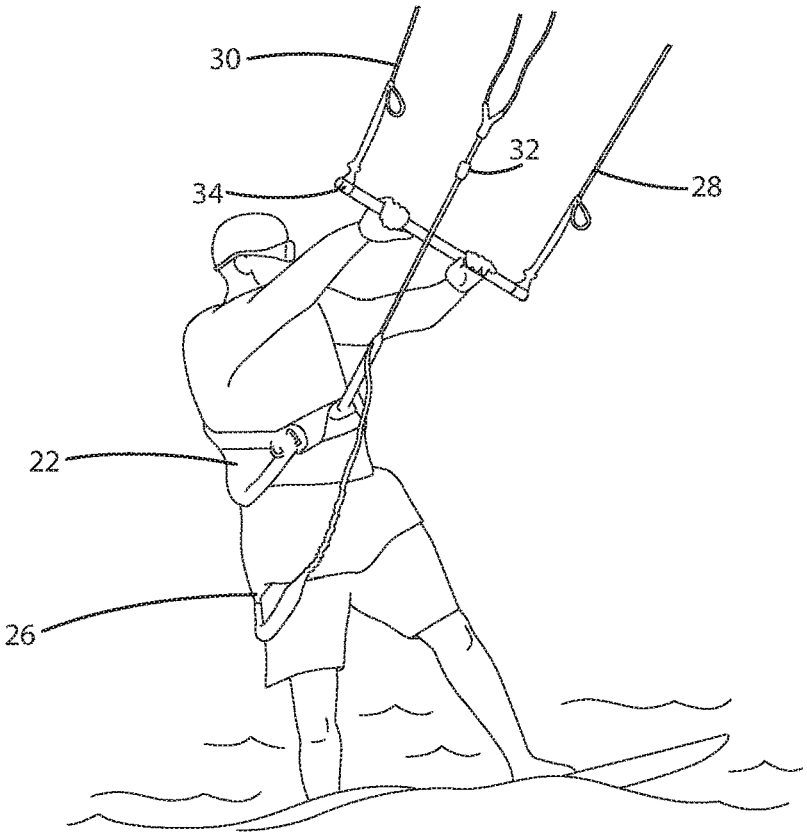
Fig. 2 (Prior art)
FIG. 2 illustrates a kiteboard user using a known harness.

FIG. 2 more clearly shows the arrangement of the steering bar 34, first steering line 28, second steering line 30 and center line 32. This figure shows the center line 32 attached near the center of the harness 22. A safety tether 26 is shown between the center line 32 and the harness 22.

Figure 3:
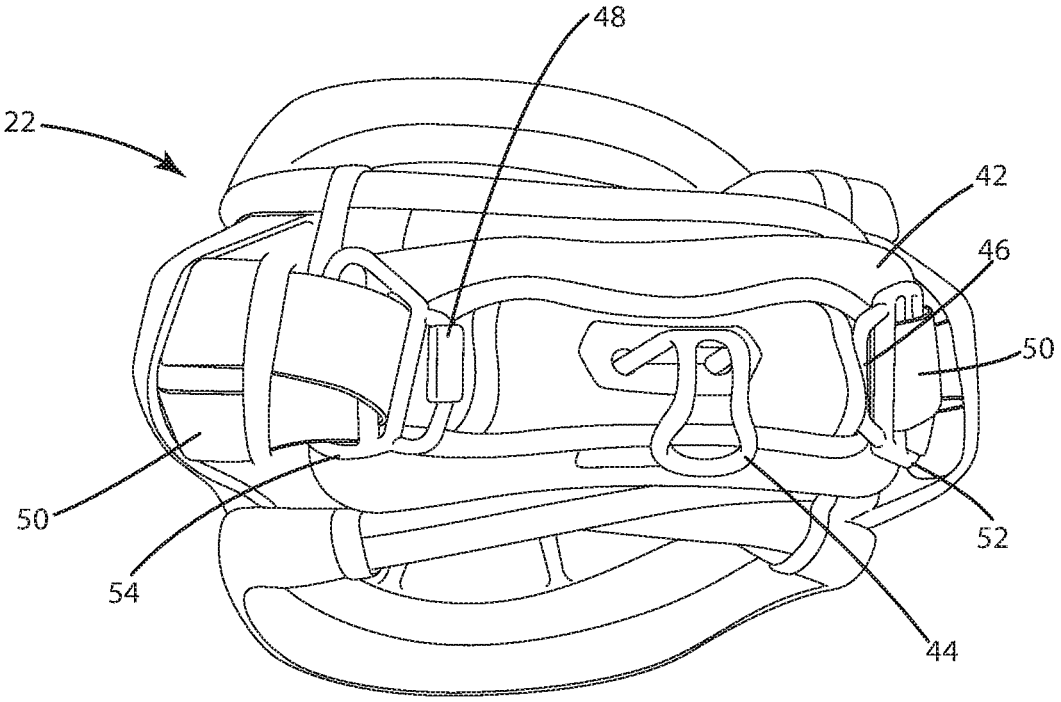
Fig. 3 (Prior art)
FIG. 3 illustrates a typical known kiteboard harness.

FIG. 3 shows a background art harness 22. This conception shows the spreader bar 42 covered by a pad and located approximately in the center of the front of the harness 22. On each end of the spreader bar 42 are hooks, first bar hook 46 and second bar hook 48. There is a center hook 44 where the center line 32 is attached during use. The spreader bar 42 is affixed to the harness 22 via the first webbing hook 52 and the second webbing hook 54. The webbing hooks 52, 54 get hooked over the first bar hook 46 and second bar hook 48 respectively. The webbing 50 then engages the webbing hooks 52, 54 gets tightened and spreader bar 42 and pad is snugged against the harness 22. The harness 22 can then have the center line 32 affixed to the center hook 44 and the wind sport harness 22 can then be used.

Figure 4:
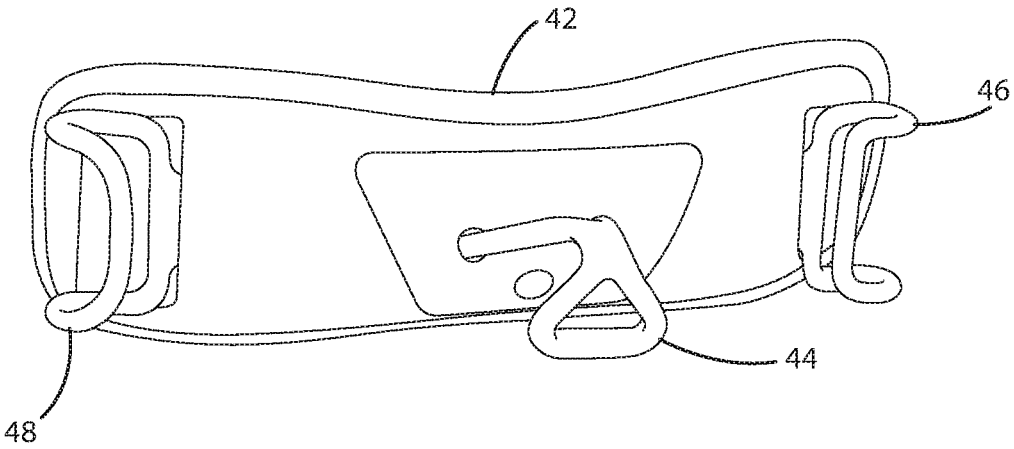
Fig. 4 (Prior art)
FIG. 4 illustrates a typical known spreader bar with end hooks.

FIG. 4 shows a front view of a background art spreader bar 42 and pad with a center hook 44, first bar hook 46 and second bar hook 48 which can more easily be seen.

Figure 5:
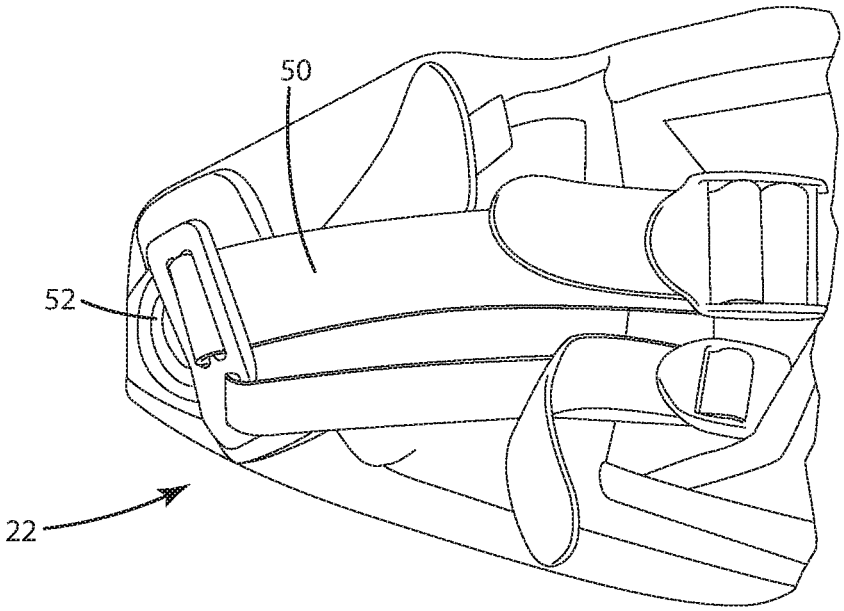
Fig. 5 (Prior art)
FIG. 5 illustrates a typical known webbing.
Figure 6:
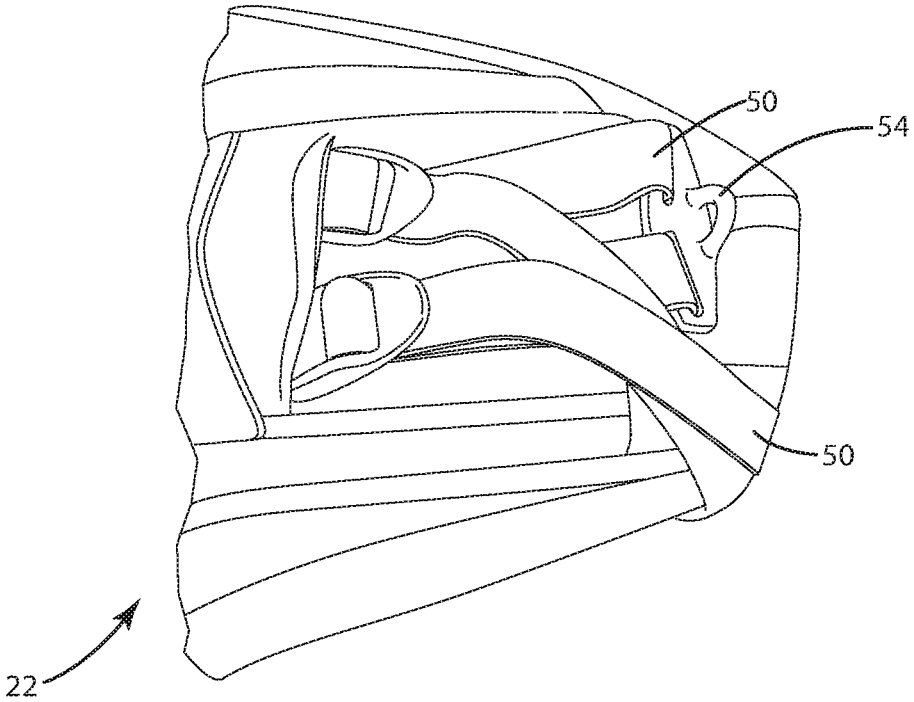
Fig. 6 (Prior art)
FIG. 6 illustrates a typical known webbing.

FIG. 5 shows background art webbing 50 and first webbing hook 52. FIG. 6 shows background art webbing 50, second webbing hook 54.

Figure 7:
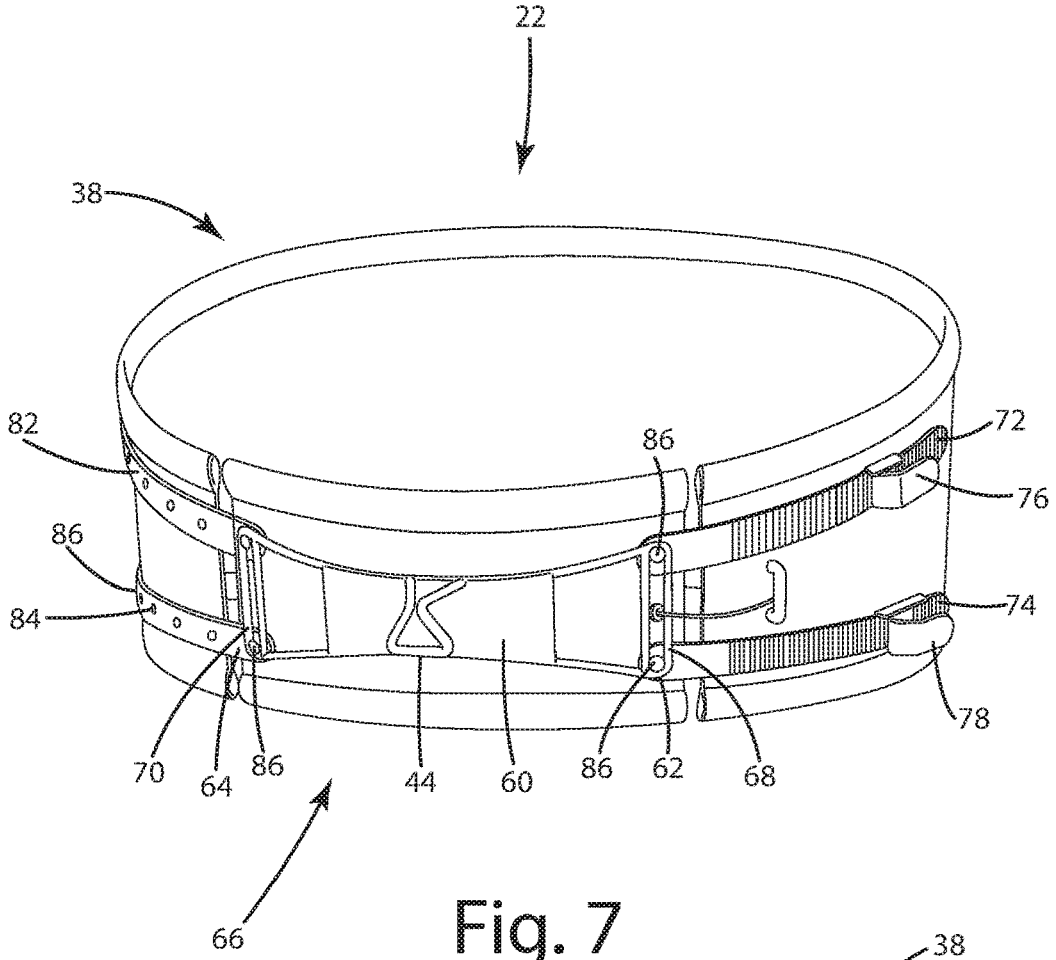
FIG. 7 illustrates a front view of an embodiment of a new internal support and adjustment system for a harness.

FIG. 7 shows a new internal support 38 and system for retaining the harness 22 snugly to the user without the harness 22 loosening up and causing discomfort. It should be understood that the internal support 38 is the structure internal to the harness 22. The internal support 38 is covered with various softer materials to aid in the comfort of the wearer. The internal support 38 and the covering make up the harness 22. This embodiment does not show any covering on the internal support 38.

These figures shows the spreader bar 60 having a center hook 44 and a first end 62 and second end 64. The ends 62, 64 each have a first bar loop 68 and second bar loop 70 respectively. As can be seen the bar loops 68, 70 are open loops and this would allow the fasteners 86 from the adjustment straps 72, 74 to be located at almost any vertical position relative to one another and the first bar loop 68. This would allow much customization in the adjustment of the internal support 38 in fitting the device to individual users. The bar loops 68, 70 could be larger with more vertical distance then those shown in this FIG. 7 to provide more adjustment to the user.

Likewise, the first fixed strap 82 and second fixed strap 84 can be located with the fasteners 86 in many positions within the second bar loop 70. This provides a benefit to the user from the aspect of comfort. When the center line 32 is affixed to the center hook 44 and the force from the center line 32 is increased, the center hook 44 would like to follow the force. If this occurs, then the top of the spreader bar 60 and internal support 38 and harness 22 would want to turn into the abdomen of the user and the bottom of the spreader bar 60 internal support 38 and harness 22 would rotate away from the user's abdomen. This is one of the problems that gets solved with these embodiments.

The background art shows one attachment point on the spreader bar 42, FIG. 4, on each end of the spreader bar 42, first bar hook 46 and second bar hook 48. These bar hooks 46, 48 are affixed to the first webbing hook 52 and second webbing hook 54. This creates in essence a single point loading, as an example, from the bar hook 46 to first webbing hook 52. The load is split into two strips of webbing 50. The net effect on the first bar hook 46 of spreader bar 42—one tensile load. It is easier for this spreader bar 42 to twist from the moment created by loading the center hook 44 with the center line 32. If only one securing point exists from the spreader bar 42 to the harness it is easier for the spreader bar 42 to rotate in the manner described.

However, if the spreader bar 60 of this disclosure, FIG. 7, is secured at two different points, for example, first fixed strap 82 and second fixed strap 84 that have a distance between each other in the second end 64 and then to the harness 22, the spreader bar 60 and internal support 38 is less likely to twist and become uncomfortable. This embodiment thereby shows two tensile loads from the spreader bar 60 to the internal support 38 and because these tensile loads are separated by a distance makes the likelihood of twisting of the spreader bar 60 and internal support 38 to occur.

This device aids in keeping the spreader bar 60 relatively flat against the user by having two separate attachment points a distance from one another at the ends of the spreader bar 60. These two attachment points, in this FIG. 7, first adjustment strap 72 and second adjustment strap 74 can be adjusted farther apart than a single point adjustment. If the load from the center line 32 becomes increased such that the harness 22 in FIG. 7 begins to twist, the user can tighten the second adjustment strap 74 to help prevent this twisting and help eliminate the discomfort and possible hazards of having an internal support 38 and harness 22 that is too loose. Many of the background art only has a single attachment on each end of the spreader bar 60, see FIG. 3 first and second bar hooks 46, 48 and first and second webbing hooks 52, 54.

As can be seen, by having a larger vertical connection on the spreader bar 60 for the adjustment straps 72, 74 can help prevent twisting of the spreader bar 16 and internal support 38 and thereby the harness 22.

Figure 8:
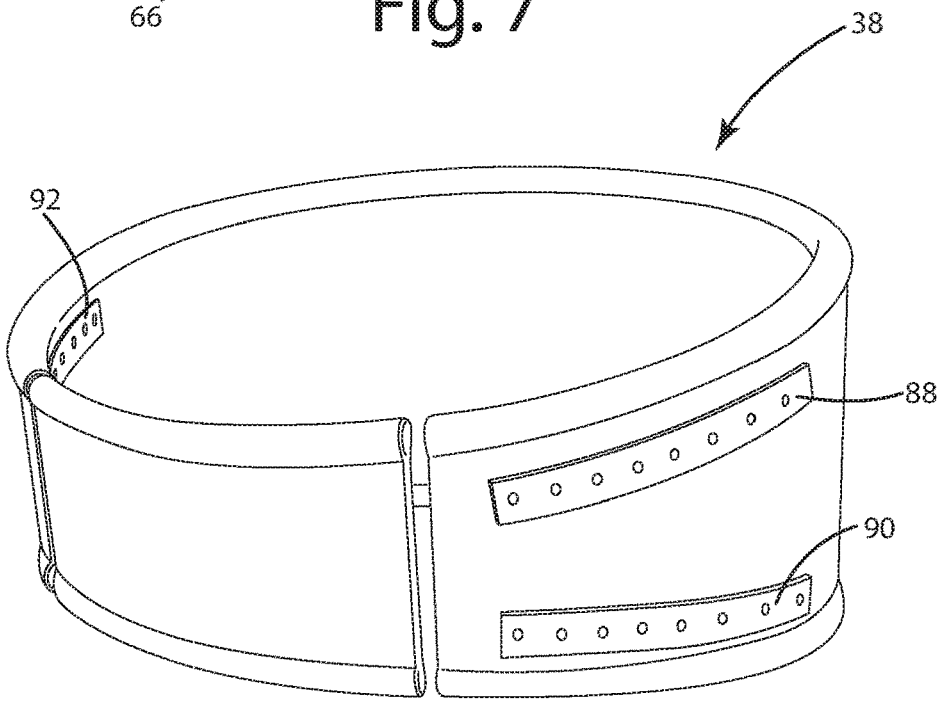
FIG. 8 illustrates a side view of the internal support embodiment of FIG. 7 without the adjustment system attached.

FIG. 8 shows the internal support 38 of FIG. 7 without some of the elements. In this figure can be seen the first ratchet base 88 and the second ratchet base 90. These are for securing the first adjustment ratchet 76 and second adjustment ratchet 78 respectively. The first adjustment ratchet 76 can have the first adjustment strap 72 inserted and the ratchet 76 can be moved back and forth to "ratchet" the adjustment strap 72 tighter. This ratchet 76 does not release the adjustment strap 72 between ratchets, but can continue to tighten the adjustment strap 72 to the user's desired tightness. There is no danger of loosening the adjustment straps while tightening the ratchets until the user specifically desires to do so. This can be a benefit in adjusting.

Likewise, the second adjustment strap 74 can be fed into the second adjustment ratchet 78 and tightened to the user's desired level.

The first and second fixed straps 82, 84 are secured with fasteners 86 to the first and second fixed bases 92, 94. The length of the harness can be adjusted by removing these fasteners 86 and adjusting the relative length of the fixed straps 82, 84.

Figure 9:
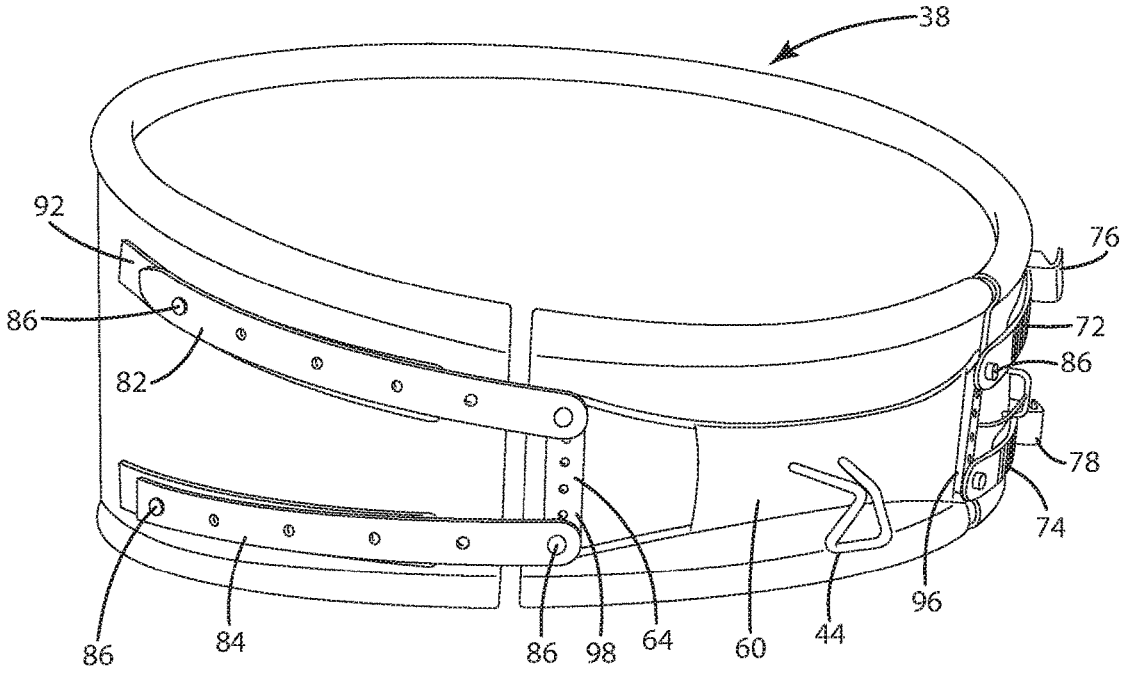
FIG. 9 illustrates a side view of view of the embodiment shown in FIG. 7 with only a fixed connection.
Figure 10:
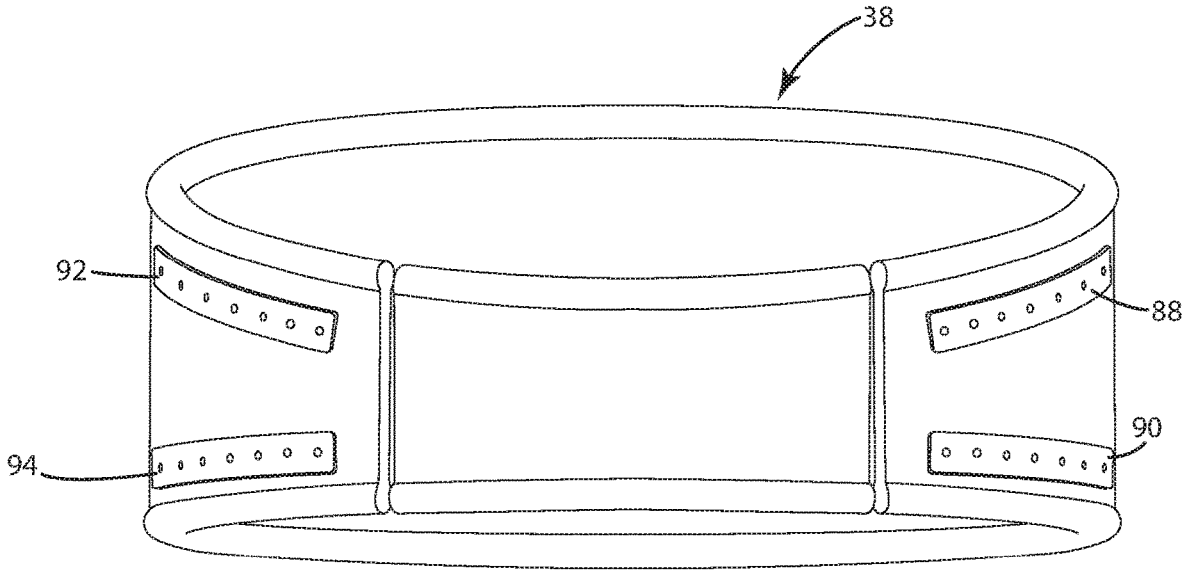
FIG. 10 illustrates a front view of the internal support of FIG. 7 without the adjustment system attached.

FIG. 9 shows an internal support 38 with another embodiment of a spreader bar 60. This spreader bar 60 has a similar structure to that shown in FIG. 7, however, the first and second ends 96, 98 are configured differently. In this embodiment, the first and second ends 96, 98 are a plate material that has had a plurality of holes there through. This provides multiple attachment points for both the first and second adjustment straps 72, 74 and the first and second fixed straps 82, 84. This embodiment likewise with the distance from the adjustment straps 72, 74 and the fixed straps 82, 84 relative to one another, aids in preventing high loads from the center line 32 affixed to the center hook 44 from twisting the top of the internal support 38 and thereby the harness 22 into the users abdomen.

Figure 11:
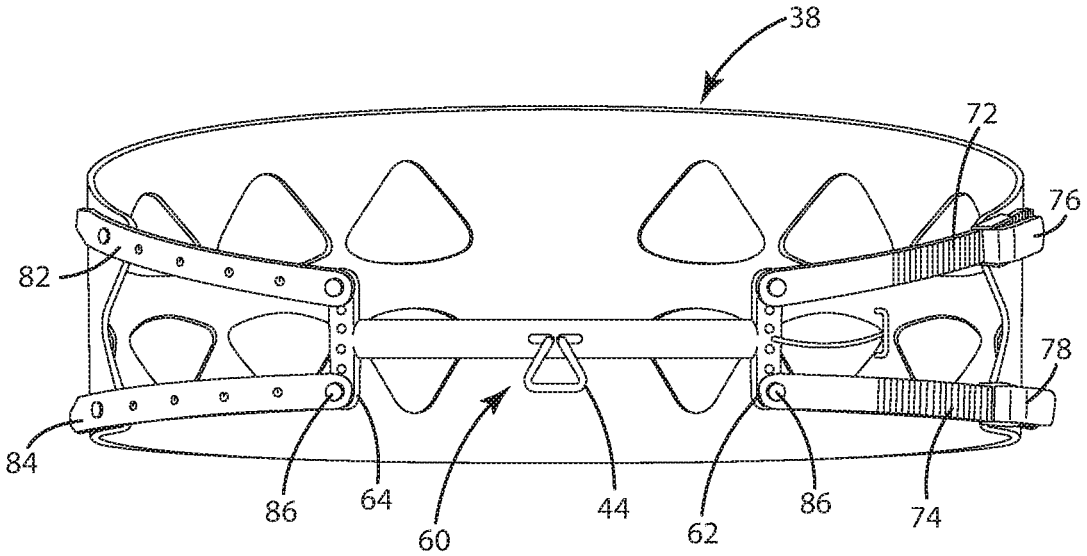
FIG. 11 illustrates an embodiment of an internal support and adjustment system.

FIG. 11 shows another embodiment of an internal support 38 and spreader bar 60. In this embodiment, the spreader bar 60 has a central segment having a first end and a second end affixed respectively to an elongate first end portion 62 and an elongate second end portion 64. The first and second elongate end portions 62, 64 may be generally perpendicular to the spreader bar 60. The elongate ends 62, 64 may be configured to attach the first and second adjustment straps 72, 74 and the first and second fixed straps 82, 84. The elongated ends 62, 64 aid in preventing and discouraging the twisting of the spreader bar 60 when the center hook 44 is under tension from the center line 32 of, for example, with a kite board. This embodiment of the spreader bar 60 is adjustable and customizable for each user. It is easily tightened via the adjustment ratchets 76, 78.

It should be noted that the adjustment straps 72, 74 may be made from material that is relatively rigid or semi-rigid, such as rubber, plastic, or the like, and water resistant such that it does not creep or stretch very much so that once a desired tension is achieved, little adjustment is necessary. The material is also strong enough to maintain its profile such that the ratchets 76, 78 will continue to index the straps with little wear.

Likewise, the first and second fixed straps 82, 84 may be made from the same material for the same desired properties.

Figure 12:
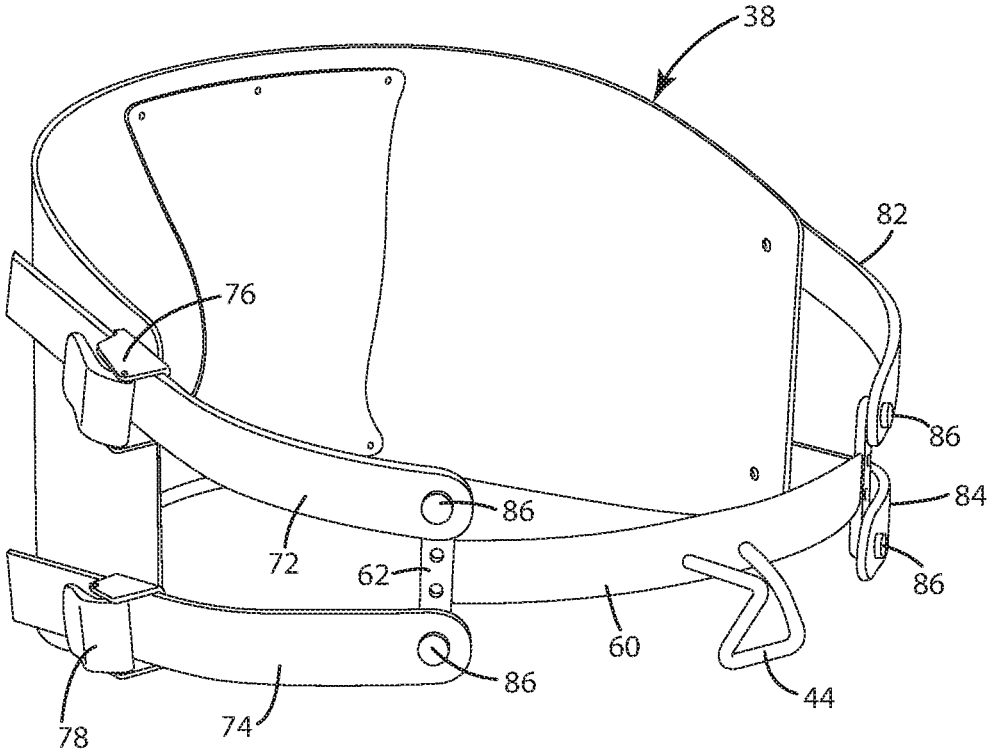
FIG. 12 illustrates a first angular side view an embodiment of an internal support and adjustment system having a lumbar support.
Figure 13:
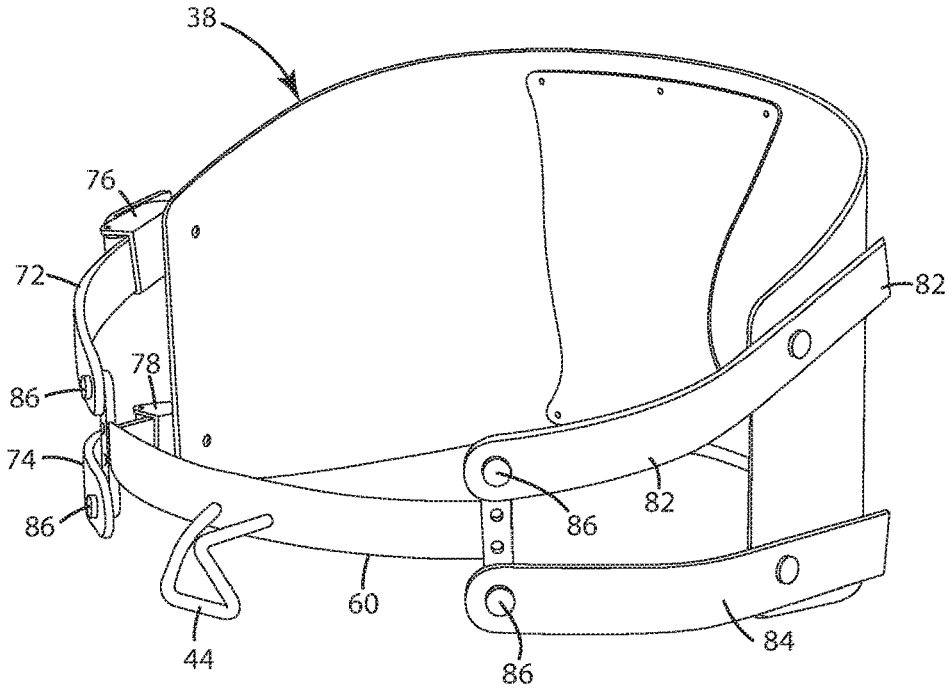
FIG. 13 illustrates a second angular side view an embodiment of an internal support and adjustment system having a lumbar support.

FIGS. 12 and 13 show angled side views of an internal support 38 similar to that of FIG. 11 but also including a lumbar support member 110 positioned in an inner surface of the internal support 38. As illustrated, the first and second adjustment straps 72, 74 may be angled with respect to one another, such as in a non-parallel arrangement, to allow selective tightening of the harness and prevent torqueing and unwanted movement. Specifically, the adjustment straps 72, 74 may be fastened or connected to the elongated end portion 62 a first distance apart, and may be fastened or connected to the internal support 38 a second distance apart, where the second distance is greater than the first distance, thus angling the first and second adjustment straps with respect to one another. It will be appreciated that the first and second fixed straps 82, 84 may be similarly arranged with respect to their connection to the second elongate end portion 64 and the internal support 38.

Figure 14:
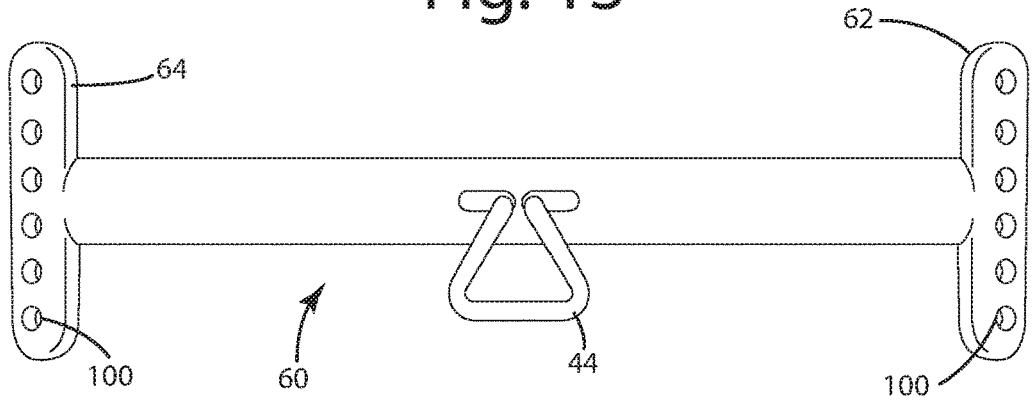
FIG. 14 illustrates a front view of an embodiment of a spreader bar.

FIG. 14 shows a front view of the spreader bar 60 of FIGS. 11-13. The spreader bar 60 includes a plurality of attachment holes 100 through each of the first and second elongate end portions 62, 64. The attachment holes 100 provide discrete options for fixing a fastener 86 there through to alter the distance between the adjustment straps at the spreader bar 60 and adjust the angularity of the adjustable and fixed straps 72, 74, 82, 84. It will be appreciated that while the figures generally show once side having adjustment straps and a second side having fixed straps, an arrangement having adjustment straps on both side of the harness could also be provided.

Figure 15:
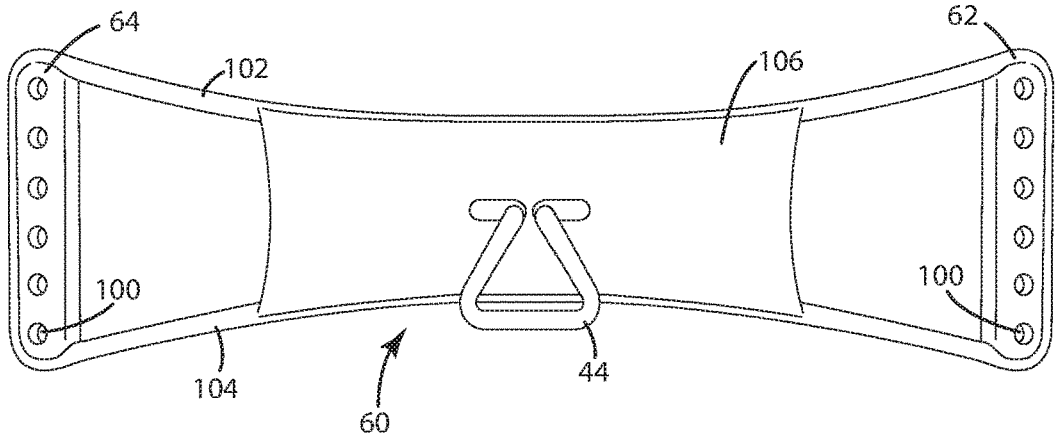
FIG. 15 illustrates a front view of an embodiment of a spreader bar.

FIG. 15 shows a front view of another embodiment of a spreader bar 60 having an upper and lower bar 102, 104, a center plate 106 and a plurality of attachment holes 100 through each of the first and second ends 62, 64.

Figure 16:
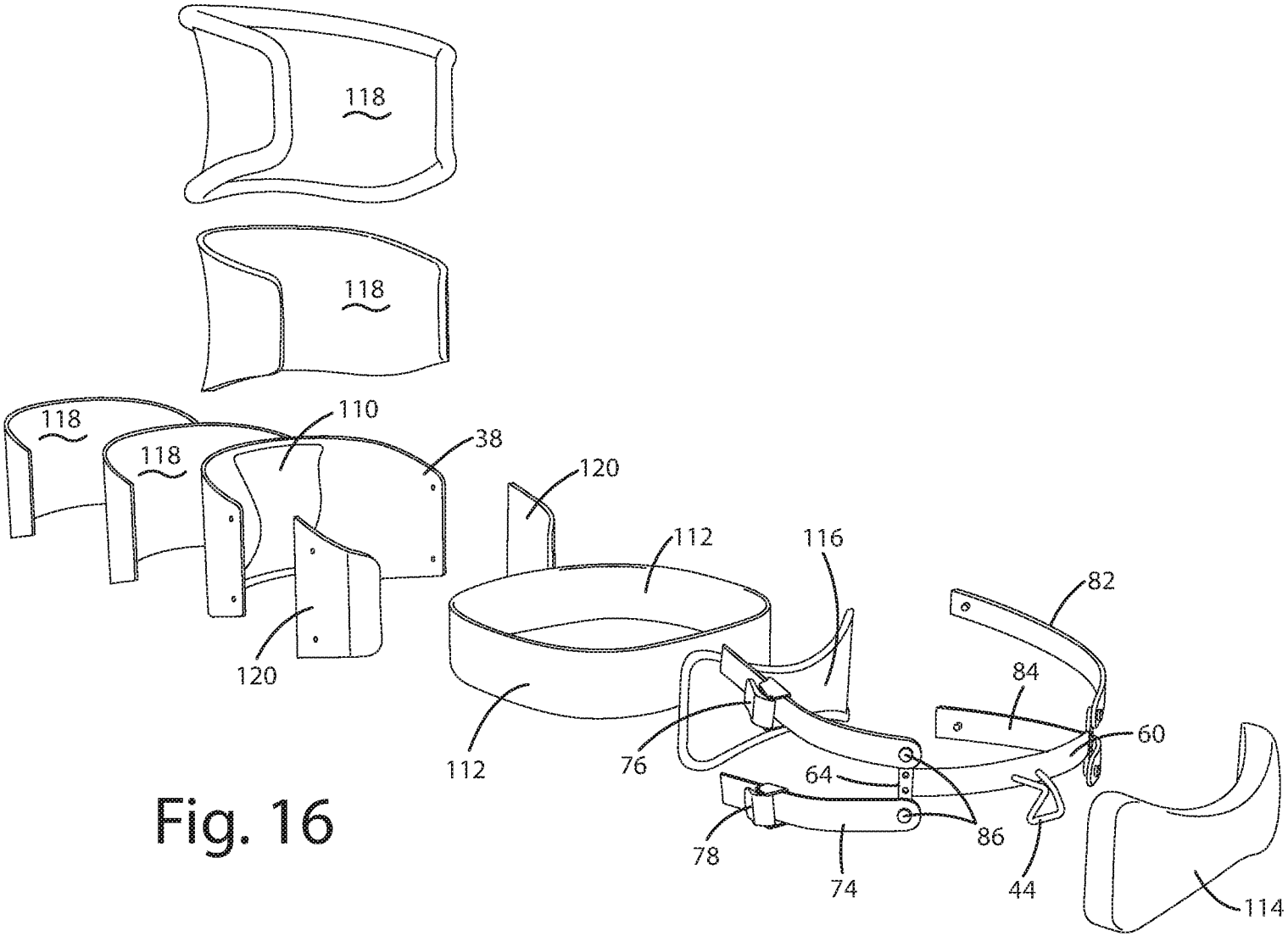
FIG. 16 illustrates an exploded view of a harness having an internal support and adjustment system.
Figure 17:
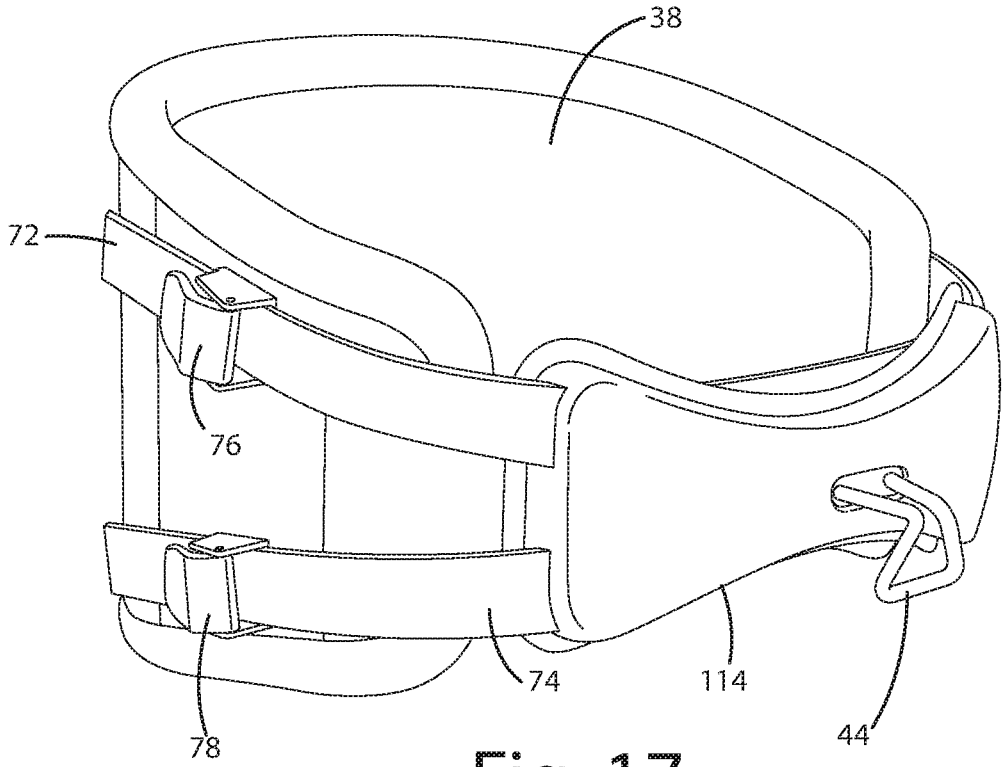
FIG. 17 illustrates a fully assembled view of a harness having an internal support and adjustment system.

FIG. 16 illustrates an exploded view of a harness having additional components for improved use. It will be appreciated that some embodiments or uses of the system herein may not include all components illustrated here. The shown embodiment includes the spreader bar 60 having elongate end portions 62, 64 and a center hook 44. A front pad 114 may cover the support bar and allow the center hook 44 to protrude, and an inner pad 116 may provide padding between the spreader bar 60 and the front body of a user. The adjustment straps 72, 74 and fixed straps 82, 84 are connected to the respective elongate end portions 62, 64 and also to the internal support 38. A lumbar support 110 may be connected to an inner surface of the inner support 38 to provide back support for a user. An elastic belt 112 may connect to the inner support 38, such as through the lumbar support 110, to surround the torso of the user. One or more inner components 118 may surround the inner support on either side, such as s memory foam layer, a neoprene layer, a vinyl backing, and a foam layer. Outer guides 120 may be positioned about ends of the harness and may help to provide stabilization and support. These components are illustrated in assembled configuration in FIG. 17.

Figure 18:
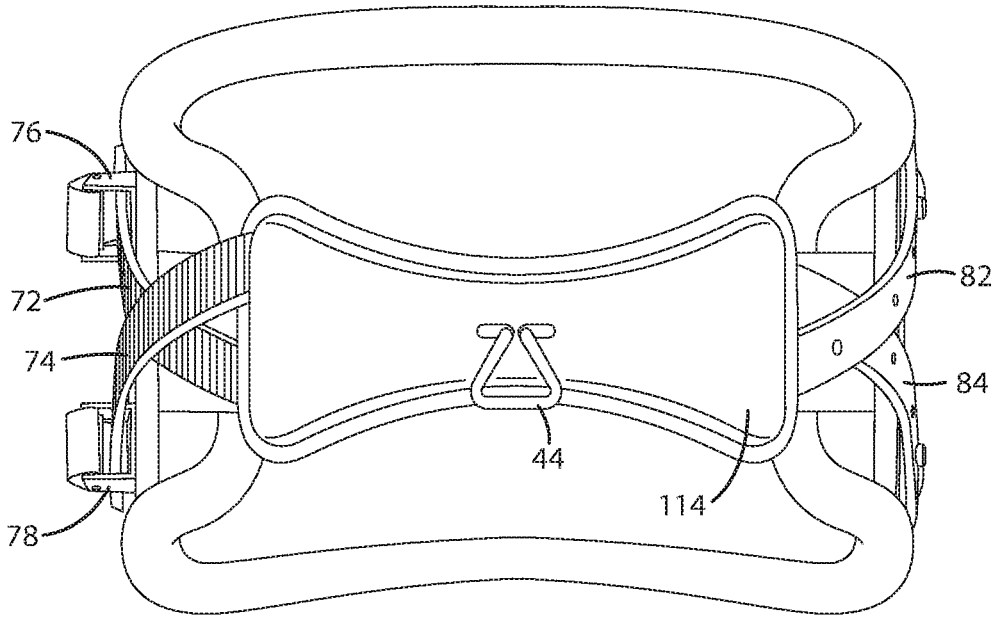

In an embodiment illustrated in FIG. 18, the adjustment straps 72, 74 and/or fixed straps 82, 84 may be arranged in a crisscrossed orientation. As with the configuration shown in FIGS. 12, 13, 16, and 17, the crisscrossed arrangement provides a non-parallel arrangement of the straps and yields greater adjustability control.

Figure 19:
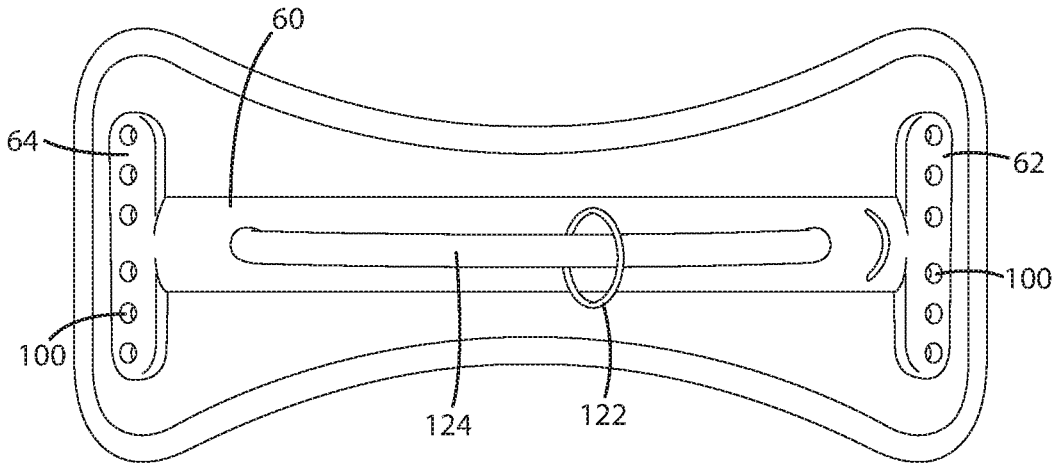

In an embodiment illustrated in FIG. 19, the spreader bar 60 may include a slidable hook 122 that is not fixed to the bar. For example, the spreader bar 60 may include a rope 124 or the like connected to its front face. The slidable hook 122 may be capable of sliding along the length of the rope 124, and thus along a portion of the spreader bar 60. The slidable hook 122 may comprise a ring connected around the rope and movable as described.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof

Having thus described the invention, we claim:

1. A harness system configured to surround the torso of a user, the harness system comprising:

a spreader bar having a first end, a second end, and a hook;

a curved support member;

an adjustment strap interconnecting the spreader bar and the curved support member;

an adjustment mechanism positioned on at least one strap, wherein the adjustment mechanism is configured to adjust the length of the adjustment strap that interconnects the spreader bar and the curved support member;

wherein the adjustment strap is formed of a semi-rigid material.

2. The harness system of claim 1, wherein the adjustment strap includes a plurality of ridges configured to interface with the adjustment mechanism.

3. The harness system of claim 1, wherein semi-rigid material comprises a rubber or plastic.

4. The harness system of claim 1, wherein the adjustment mechanism comprises a ratchet.

5. The harness system of claim 1, wherein the spreader bar includes a first elongate end portion at its first end and a second elongate end portion at its second end.

6. The harness system of claim 5, wherein the first and second elongate end portions each include a plurality of discrete connection points.

7. The harness system of claim 6, wherein the discrete connection points comprise openings in the first and second elongate portions.

8. The harness system of claim 1 further comprising a fixed strap connected to the spreader bar at a first connection point and connected to the support member at a second connection point.

9. The harness system of claim 1, wherein the hook is fixed to the spreader bar at the center point of the bar.

10. The harness system of claim 1, wherein the hook is slidable along at least a portion of the spreader bar.

11. The harness of claim 1, wherein the hook comprises a ring positioned around a rope that is connected to a front surface of the spreader bar.

12. The harness system of claim 1 further comprising an elastic belt connected to an interior surface of the curves support member, wherein the elastic belt is configured to surround the waist or torso portion of a user.

13. The harness system of claim 1 further comprising a lumbar support member located on an interior surface of the curved support member.

14. The harness system of claim 1 further comprising one or more padding or support components connected to the curved support member.

* * * * *